US009803646B2

(12) United States Patent
Li

(10) Patent No.: US 9,803,646 B2
(45) Date of Patent: Oct. 31, 2017

(54) FAN WITH LIMITING-POSITION DEVICE

(71) Applicant: Qiwu Li, Shenzhen (CN)

(72) Inventor: Qiwu Li, Shenzhen (CN)

(73) Assignee: HAOYU XING, Shenzhen (CN)

( * ) Notice: Subject to any disclaimer, the term of this patent is extended or adjusted under 35 U.S.C. 154(b) by 162 days.

(21) Appl. No.: 14/439,220

(22) PCT Filed: Nov. 6, 2012

(86) PCT No.: PCT/CN2012/084116
§ 371 (c)(1),
(2) Date: Apr. 28, 2015

(87) PCT Pub. No.: WO2014/067168
PCT Pub. Date: May 8, 2014

(65) Prior Publication Data

US 2015/0292509 A1 Oct. 15, 2015

(30) Foreign Application Priority Data

Nov. 5, 2012 (CN) ..... 2012 1 0435248

(51) Int. Cl.
*F04D 19/00* (2006.01)
*F04D 29/54* (2006.01)
*F04D 29/64* (2006.01)

(52) U.S. Cl.
CPC ..... *F04D 19/002* (2013.01); *F04D 29/542* (2013.01); *F04D 29/646* (2013.01)

(58) Field of Classification Search
CPC ..... F04D 29/542; F04D 29/646; F04D 19/002
See application file for complete search history.

(56) References Cited

U.S. PATENT DOCUMENTS 2,100,946 A * 11/1937 De Mey ..... F04D 29/646 415/134
2,652,193 A * 9/1953 Lindberg ..... F04D 29/646 415/121.2
3,019,965 A * 2/1962 Lyman ..... F04D 25/12 417/423.1
3,261,107 A * 7/1966 Ponczek ..... H02K 7/145 15/315

(Continued)

FOREIGN PATENT DOCUMENTS

CN 1793666 A 6/2006
CN 1912396 A 2/2007

(Continued)

OTHER PUBLICATIONS

Xu Changhong, the International Searching Authority written comments, dated Aug. 2013, CN.

*Primary Examiner* — Woody Lee, Jr.

(57) ABSTRACT

A fan of the present disclosure includes a housing, an air guiding device, and a fan blade, where the an guiding device and the fan blade are arranged in the housing, and the an guiding device is used to guide air. The air guiding device includes a fixed ring. A limiting-position device is arranged in the fan, and is structured and arranged to limit and fix the air guiding device, which makes the air guiding device not shake and firmly fixes the air guiding device in the housing of the fan, further makes the air guiding device maintain a normal working state.

11 Claims, 3 Drawing Sheets

(56) References Cited

U.S. PATENT DOCUMENTS

| | | | | | |
|---|---|---|---|---|---|
| 3,976,393 | A * | 8/1976 | Larson | F04D 29/664 415/119 |
| 4,780,052 | A * | 10/1988 | Pradelle | F04D 29/545 415/119 |
| 5,816,781 | A | 10/1998 | Bercot et al. | |
| 7,306,425 | B2 * | 12/2007 | Park | F01D 5/10 415/119 |
| 2003/0053908 | A1 * | 3/2003 | Takashima | H05K 7/20172 415/200 |

FOREIGN PATENT DOCUMENTS

| | | | |
|---|---|---|---|
| CN | 201836095 | U | 5/2011 |
| CN | 202251110 | U | 5/2012 |
| CN | 202867357 | U | 4/2013 |
| JP | 2006097609 | A | 4/2006 |
| JP | 2012007597 | A | 1/2012 |
| KR | 20030052301 | A | 6/2003 |

* cited by examiner

FAN WITH LIMITING-POSITION DEVICE

This application is a National Stage Application of PCT application PCT/CN2012/084116 filed on Nov. 6, 2012, which is based on and claims priority to Chinese patent application 201210425248.1 filed on Nov. 5, 2012. The entirety of each of the above-mentioned applications is hereby incorporated by reference herein in its entirety.

TECHNICAL FIELD

The present disclosure relates to the field of electrical appliances, and more particularly to a fan.

BACKGROUND

China patent application number 201220572475.4, filed by applicant, describes a fan including a housing, an air guiding device, an electric motor, and a fan blade, where the air guiding device, the electric motor, and the fan blade are arranged in the housing of the fan. The air guiding device includes a fixed ring, a fixed piece, and an air guiding sheet that is arranged between the fixed ring and the fixed piece. The electric motor is arranged in the fixed piece, the fan blade is arranged in the fixed ring, and the air guiding sheet is fit to the fan blade and is arranged on an upper part of the fan blade. An upper end of the housing is configured with an air-out channel, and the air-out channel is connected with an air flue in an air-out device. The air-out device has no fan blade, therefore, air generated by rotation of the fan blade is guided to the air-out channel by the air guiding sheet and is blown to the air flue of the air-out device. Thus, air is blown out from the air-out device. The fixed ring is fixed on the housing through a screw, where the screw may loosen because of shaking generated by the electric motor in a working state, which makes the fixed ring, not be firmly fixed and makes the fan run abnormally.

SUMMARY

The aim of the present disclosure is to provide a fan having a fixed ring being firmly fixed.

The aim of the present disclosure is achieved by the following methods: the fan comprises a housing, an air guiding device, and a fan blade, where the air guiding device and the fan blade are arranged in the housing of the fan. The air guiding device comprises a fixed ring. A limiting-position device is arranged at the fan and is structured and arranged to limit and fix the air guiding device.

Furthermore, the limiting-position device comprises a first circular flange arranged on an internal surface in a middle of the housing. An edge of a bottom end of the fixed ring is arranged on the first flange and is in contact with the first flange, which limits the fixed ring in a downward direction, and makes the fixed ring be firmly fixed.

Furthermore, an inner diameter of the first flange is greater than an inner diameter of the fixed ring, which makes the fixed ring be arranged on the first flange, further improving limiting effect.

Furthermore. The limiting-position device further comprises a second circular flange arranged on a top end of the housing and a third flange arranged in a horizontal direction along the fixed ring, where the second flange is arranged at an upper part of the third flange, and an inner diameter of the second flange is greater than an inner diameter of the third flange and is less than an external diameter of the third flange. The second flange of the top end of the housing of the fan is fit to the third flange of the fixed ring, thus, the second flange of the top end of the housing of the fan limits the fixed ring in an upward direction, which makes the fixed ring be firmly fixed.

Furthermore, the limiting-position device comprises a fourth flange arranged in a vertical direction along the fixed ring, where the fourth flange is perpendicular to the third flange and is arranged on the upper part of the third flange. An inner diameter of the fourth flange is equal to the inner diameter of the fixed ring, and an external diameter of the fourth flange is less than the inner diameter of the second flange. And the fourth flange limits the second flange, which improves matching of the second flange and the third flange, and improves limiting effect of the second flange for the fixed ring.

Furthermore, the housing comprises a front housing and a rear housing. Bottom ends of the front and rear housing both are configured with air inlets, and the first flange is arranged at an edge of an upper part of the air inlet, which make air easily enter the air inlet, and improve wind speed.

Furthermore, the housing comprise the front housing and the rear housing, and the front housing is fixed to the rear housing through a screw, where connection positions of the front housing and the rear housing are configured with a convex lug of the front housing and a convex lug of the rear housing, and the convex lug of the front housing is fit to the convex lug of the rear housing. The convex lug of the front housing is configured with a screw hole column, and the convex lug of the rear housing corresponding is configured with a screw hole, or the convex hug of the rear housing is configured with a screw hole column, and the convex lug of the front housing corresponding is configured with a screw hole. Where the convex lug of the front housing is fixed to the convex lug of the rear housing through the screw. The fixed ring is configured with a convex lug corresponding to the convex lug of the front housing and the convex lug of the rear housing, where the convex lug, of the fixed ring is fixed between the convex lug of the front housing and the rear housing, which avoids affecting arrangement of the fan blade because the screw hole and the screw hole column are directly arranged at the housing and the fixed ring, and further avoids reduction of the wind speed and uneven air flow. The above-mentioned fixed method is simple and improves fixing of the structure.

Furthermore, the convex lug of the fixed ring is configured with the screw hole, and the convex lug of the rear housing is correspondingly configured with the screw hole column, where the convex lug of the fixed ring is fixed to the convex lug of the rear housing through the screw. Or the convex lug of the front housing corresponding is configured with the screw hole column, where the convex lug of the fixed ring is fixed to the convex lug of the front housing through the screw. This is a specific example of fixing the fixed ring, and makes the fixed ring be firmly fixed.

Furthermore, number of the screw hole of the convex lug of the fixed ring is two, and the two screw holes are arranged at two ends of the convex lug of the fixed ring, respectively, which makes the fixed ring be firmly fixed in the housing.

Numbers of the screw hole of the convex lug of the front housing and the screw hole column of the convex lug of the rear housing are both two, and the two screw holes of the convex lug of the front housing and the two screw hole columns of the convex lug, of the rear housing are corresponding to the two ends of the convex lug of the fixed ring, respectively, which improves fixing of the front housing and the rear housing, and makes the fixed ring be firmly fixed in the housing.

Furthermore, a rectangular reinforcing rib is arranged between the screw hole columns that are fit to the screw hole of the convex lug of the fixed ring, which improves strength of the screw hole column of the housing.

The present disclosure provides the limiting-position device that limits and fixes the air guiding device, which makes the air guiding device not shake and firmly fixes the air guiding device in the housing of the fan, further making the air guiding device to maintain a normal working state.

Figure 1:
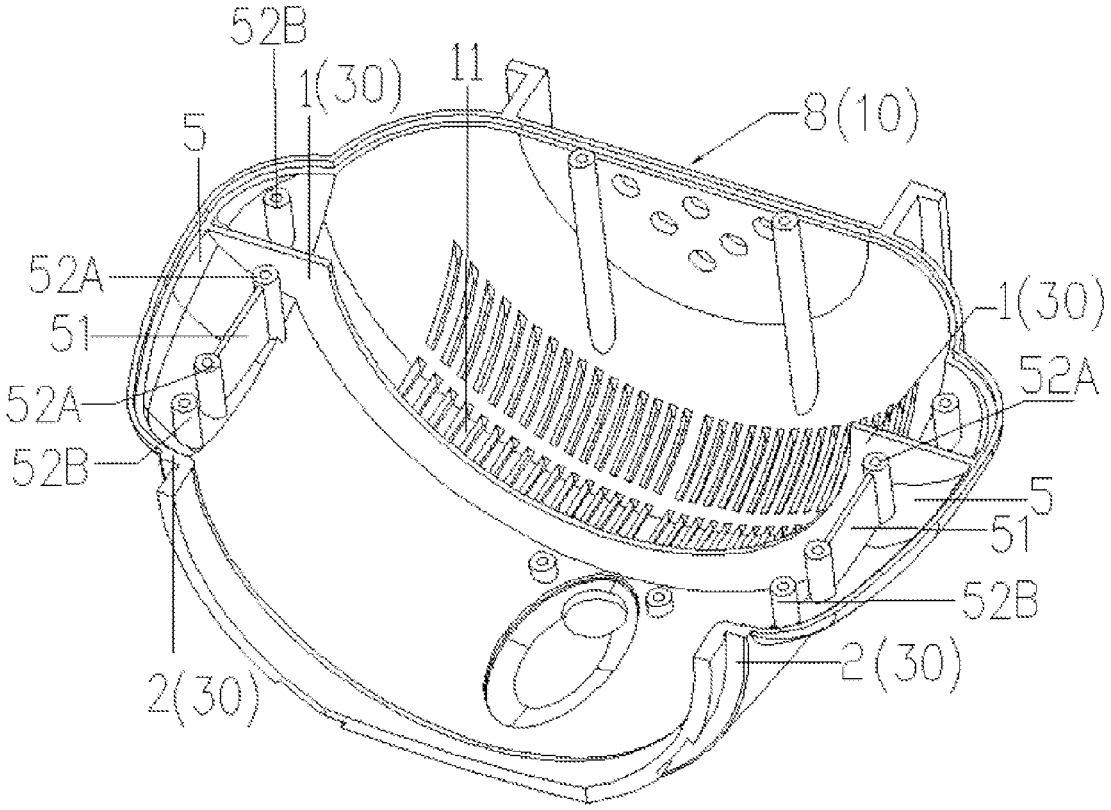
FIG. 1 is a structural diagram of a front housing of a first example of the present disclosure.

Legends: 1. first flange; 2. second flange; 3. third flange; 4, fourth flange; 5. convex lug of the front housing; 51. reinforcing rib; 6. convex lug of the rear housing; 7. convex lug of the fixed ring 10. housing; 11. air inlet; 100. fan; 20. air guiding device; 21. fixed ring; 30. limiting-position device; 40. fan blade; 52A. screw hole column; 52B. screw hole column; 60. air-out device; 71A. screw hole; 71B. screw hole; 8. front housing; 9. rear housing.

DETAILED DESCRIPTION

The present disclosure will further be described in detail in accordance with the figures and the exemplary examples.

A fan 100 of the present disclosure comprises a housing 10, and an air guiding device 20 arranged in the housing 10, where the air guiding device 20 is used to guide air. As shown in FIG. 1-FIG. 4, the air guiding device 20 comprises a fixed ring 21. A limiting-position device 30 is arranged in the fan 100, and is structured and arranged to limit and fix the air guiding device 20, which makes the air guiding device not shake and firmly fixes the air guiding device in the housing of the fan, further making the air guiding device to maintain a normal working state.

The fan 100 of the present disclosure further comprises an air-out device 60, a fan blade 40, and an electric motor. The air-out device 60 is arranged at a top part of the housing 10, an air inlet 11 is arranged in the housing 10, and an air flue is arranged between the housing 10 and the air-out device 60. An air outlet is arranged on the air-out device 60. The housing 10 comprises a front housing 8 and a rear housing 9, where the front housing 8 is fixed to the rear housing 9 through a screw. The electric motor and the fan blade 40 are arranged in the fixed ring 20 of the housing 10. Air generated by rotation of the fan blade 40 is guided in the air-out device 60 by the air flue, and is blown out from the air outlet, where the air-out device does not have a fan blade. The air guiding device comprises the fixed ring 20, an air guiding sheet, and a fixed piece, where the fixed piece and the air guiding sheet are arranged in the fixed ring. The air guiding sheet is fitted to the fan blade, which makes air in the housing be fully blown out, further improving wind speeds. The fixed ring is limited and fixed, namely the fan blade and the electric motor are limited and fixed, thus, the fixed ring is firmly fixed, which makes the fan blade and the electric motor to maintain a normal working state.

In the example, the limiting-position device 30 comprises a first circular flange 1 arranged on an internal surface in a middle of the housing 10. An edge of a bottom end of the fixed ring 21 is arranged on the first flange 1 and is in contact with the first flange 1, which limits the fixed ring in a downward direction, and avoids movement of the fixed ring due to its own weight. Thus, the fixed ring is firmly fixed. An inner diameter of the first flange 1 is greater than an inner diameter of the fixed ring 21, which ensures that the fixed ring is arranged on the first flange, further improving limiting effect. The limiting-position device 30 further comprises a second circular flange 2 arranged on a top end of the housing and a third flange 3 arranged in a horizontal direction along the fixed ring 21, where the second flange 2 is arranged on an upper part of the third flange 3, and an inner diameter of the second flange 2 is greater than an inner diameter of the third flange 3 and is less than an external diameter of the third flange 3. The second flange 2 of the top end of the housing of the fan is fit to the third flange 3 of the fixed ring, thus, the second flange 2 of the top end of the housing of the fan limits the fixed ring in an upward direction, which makes the fixed ring be firmly fixed. The top end of the housing 10 and a bottom end of the housing 10 both are configured with the flanges (the first flange 1 and the second flange 2) to limit the fixed ring, thus, the fixed ring in vertical direction is limited between the flanges (first flange 1 and the second flange 2).

In the example, the housing 10 comprises the front housing 8 and the rear housing 9, and the front housing 8 is fixed to the rear housing 9 through a screw, where connection positions of the font housing 8 and the rear housing 9 are configured with a convex lug 5 of the front housing 8 and a convex lug 6 of the rear housing 9, and the convex lug 5 of the front housing is fit to the convex lug 6 of the rear housing. The convex lug 5 of the front housing is configured with a screw hole column 52B, and the convex lug 6 of the rear housing is correspondingly configured with a screw hole 71B, where the convex lug 5 of the front housing is fixed to the convex lug 6 of the rear housing through the screw. The fixed ring 21 is configured with a convex lug 7 corresponding to the convex lug 5 of the front housing and the convex lug 6 of the rear housing, where the convex lug 7 of the fixed ring is fixed between the convex lugs of the front housing and the rear housing, which avoids affecting arrangement of the fan blade because the screw hole and the screw hole column are directly arranged at the housing and the fixed ring, and further avoids reduction of wind speed and uneven flow of air. The above-mentioned fixed method is simple and improves fixed effect. It should be understand that the convex lug 5 of the front housing is configured with the screw hole and the convex lug 6 of the rear housing is correspondingly configured with the screw hole column, which has a same effect as the above-mentioned method.

Figure 2:
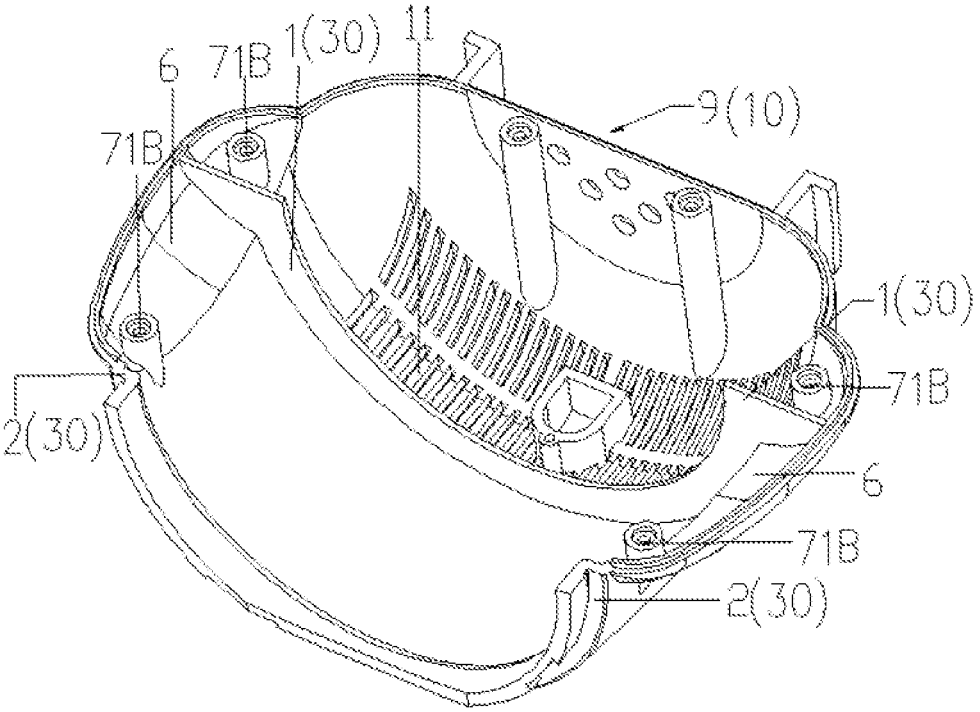
FIG. 2 is a structural diagram of a rear housing of the first example of the present disclosure.

In the example, as shown in FIG. 1 and FIG. 2, root parts of the convex lugs of the front housing, the rear housing, and the fixed ring are greater than top parts of the convex lugs of the front housing, the rear housing, and the fixed ring, which increases stability of the convex lugs and avoids damage of the root parts of the convex lugs.

Figure 3:
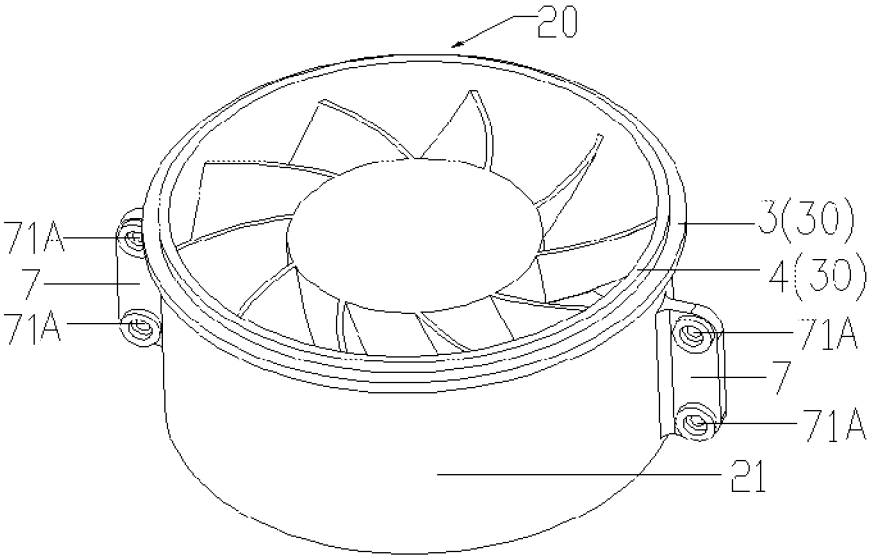
FIG. 3 is a structural diagram of an air guiding device of the present disclosure.
Figure 4:
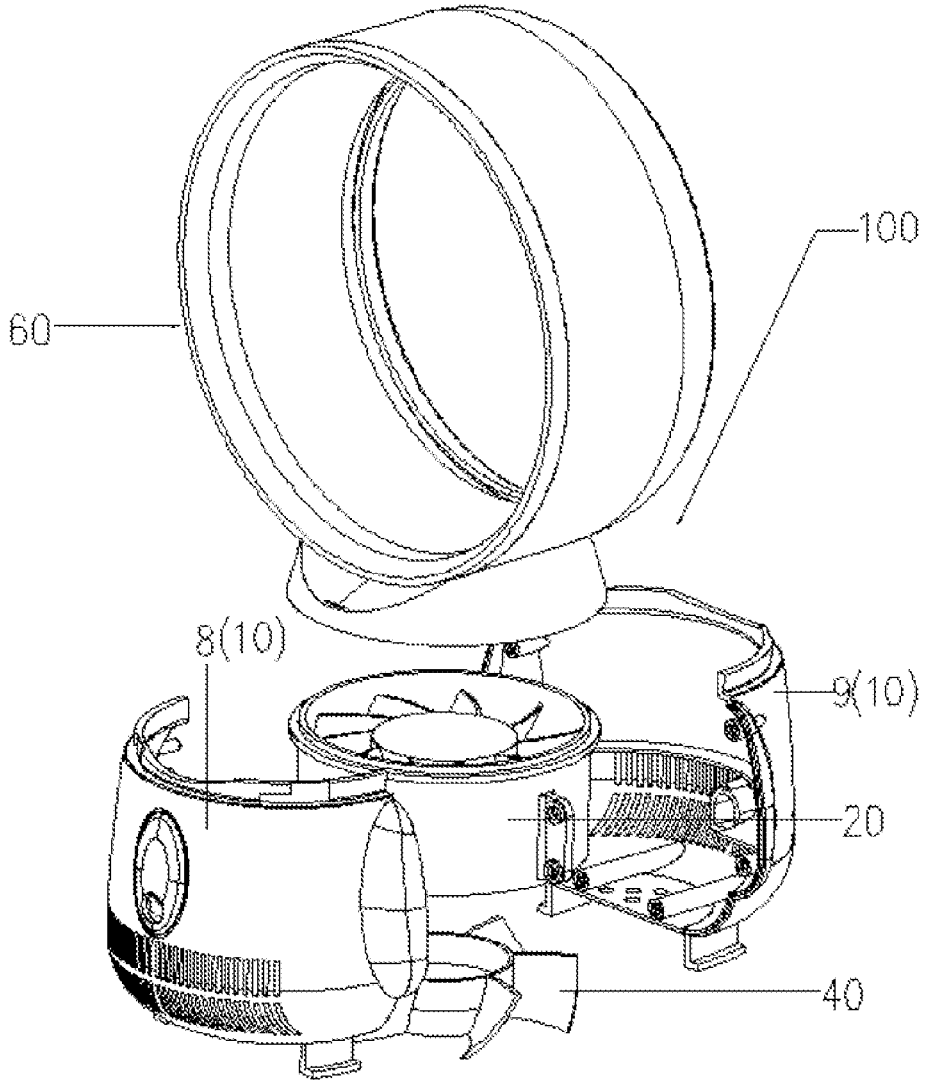
FIG. 4 is a structural diagram of a fan of the present disclosure.

In the example, as shown in FIG. 3, the convex lug 7 of the fixed ring is configured with the screw hole 71A, and the convex lug 5 of the front housing is correspondingly configured with the screw hole column 52A, the convex lug 7 of the fixed ring is fixed to the convex lug 5 of the front housing through the screw which is a specific method of fixing the fixed ring, and makes the fixed ring be firmly fixed. It should be understand that, the convex lug 7 of the fixed ring is configured with the screw hole and the convex lug 6 of the rear housing is correspondingly configured with the screw hole column, which has a same effect as the above-mentioned method.

In the example, number of the screw hole of the convex lug 7 of the fixed ring is two, and the two screw holes are arranged at two ends of the convex lug of the fixed ring, respectively. Numbers of the screw hole of the convex lug of the front housing and the screw hole column of the convex lug of the rear housing are both two, and the two screw holes of the convex lug of the front housing and the two screw hole columns of the convex lug of the rear housing are corresponding to the two ends of the convex lug 7 of the fixed ring, respectively, which improves fixing of the front and rear housing, and makes the fixed ring be firmly fixed in the housing. A rectangular reinforcing rib 51 is arranged between the screw hole columns that are fit to the screw hole of the convex lug 7 of the fixed ring, which improves strength of the screw hole column of the housing. The strip-type reinforcing rib can improve strength and is easily arranged however, it should be understood that the reinforcing rib can be other structures.

In a second example of the fan of the present disclosure, as shown in FIG. 3, the limiting-position device 30 further comprises a fourth flange 4 arranged in a vertical direction along the fixed ring 21, where the fourth flange 4 is perpendicular to the third flange 3 and is arranged on the upper part of the third flange 3. An inner diameter of the fourth flange 4 is equal to the inner diameter of the fixed ring, and an external diameter of the fourth flange 4 is less than the inner diameter of the second flange 2. The fourth flange 4 limits the second flange 2, which improves matching of the second flange 2 and the third flange 3, and improves limiting effect of the second flange 2 for the fixed ring. Other structures are same as the first example and have same effect, thus, it will not be described in detail.

The present disclosure is described in detail in accordance with the above contents with the specific exemplary examples. However, this present disclosure is not limited to the specific examples. For the ordinary technical personnel of the technical field of the present disclosure, on the premise of keeping the conception of, the technical personnel can also make simple deductions or replacements, and all of which should be considered to belong to the protection scope of the present disclosure.

We claim:

1. A fan, comprising:

a housing;

an air guiding device comprising a fixed ring;

a fan blade; and a limiting-position device of flange structure;

wherein the air guiding and the fan blade are arranged in the housing; the limiting-position device is structured and arranged to limit and fix the air guiding device;

wherein the limiting-position device comprises a first circular flange arranged on an internal surface in a middle of the housing; an edge of a bottom end of the fixed ring is arranged on the first circular flange and is in contact with the first circular flange;

wherein the limiting-position device further comprises a second circular flange arranged on a top end of the housing and a third flange arranged in a horizontal direction along the fixed ring: the second flange is arranged on an upper part of the third flange, and an inner diameter of the second flange is greater than an inner diameter of the third flange and is less than an external diameter of the third flange;

wherein the limiting-position device further comprises a fourth flange arranged in a vertical direction along the fixed ring, and the fourth flange is perpendicular to the third flange and is arranged on the upper part of the third flange; an inner diameter of the fourth flange is equal to the inner diameter of the fixed rum, and an external diameter of the fourth flange is less than the inner diameter of the second flange.

2. The fan of claim 1, wherein an inner diameter of the first flange is greater than an inner diameter of the fixed ring.

3. The tan of claim 1, wherein the housing comprises a front housing and a rear housing; bottom ends of the front and rear housing both are configured with an air inlet, and the first flange is arranged at an edge of an upper part of the air inlet.

4. The fan of claim 1, wherein the housing comprises a front housing and a rear housing; the front housing is fixed to the rear housing through a screw, connection positions of the front housing and the rear housing are configured with a convex lug of the front housing and a convex lug of the rear housing, and the convex lug of the front housing is fit to the convex lug of the rear housing; the convex lug of the front housing is configured with a screw hole column, and the convex lug of the rear housing corresponding is configured with a screw hole; the convex lug of the front housing is fixed to the convex lug of the rear housing through the screw; the fixed ring is configured with a convex lug corresponding to the convex lug of the front housing and the convex lug of the rear housing, and the convex lug of the fixed ring is fixed between the convex lug of the front housing and the rear housing.

5. The fan of claim 4, wherein the convex lug of the fixed ring is configured with the screw hole, and the convex lug of the rear housing is correspondingly configured with the screw hole column, the convex lug of the fixed ring is fixed to the convex lug of the front housing through the screw; or the convex lug of the front housing is configured with the screw hole column, the convex lug of the fixed ring is fixed to the convex lug of the front housing through the screw.

6. The fan of claim 5, wherein number of the screw hole of the convex lug of the fixed ring is two, and the two screw holes are arranged at two ends of the convex lug of the fixed ring, respectively; numbers of the screw hole of the convex lug of the front housing and the screw hole column of the convex lug of the rear housing are both two, and the two screw holes of the convex lug of the front housing and the two screw hole columns of the convex lug of the rear housing are corresponding to the two ends of the convex lug of the fixed ring, respectively.

7. The fan of claim 6, wherein a rectangular reinforcing rib is arranged between the screw hole columns that are fit to the screw holes of the convex lug of the fixed ring.

8. A fan, comprising:

a housing;

an air guiding device comprising a fixed ring;

a fan blade; and a limiting-position device of flange structure;

wherein the air guiding and the fan blade are arranged in the housing; the limiting-position device is structured and arranged to limit and fix the air guiding device;

wherein the housing comprises a front housing and a rear housing; the front housing is fixed to the rear housing through a screw, connection positions of the front housing and the rear housing are configured with a convex lug of the front housing and a convex lug of the rear housing, and the convex lug of the flout housing is fit to the convex lug of the rear housing; the convex lug of the front housing is configured with a screw hole column, and the convex lug of the rear housing corresponding is configured with a screw hole; the convex lug of the front housing is fixed to the convex lug of the rear housing through the screw; the fixed ring is configured with a convex lug corresponding to the convex lug of the front housing and the convex lug of the rear housing, and the convex lug of the fixed ring is fixed between the convex lug of the front housing and the rear housing.

9. The fan of claim 8, wherein the convex lug of the fixed ring is configured with the screw hole, and the convex lug of the rear housing is correspondingly configured with the screw hole column, the convex lug of the fixed ring is fixed to the convex lug of the front housing through the screw; or the convex lug of the front housing is configured with the screw hole column, the convex lug of the fixed ring is fixed to the convex lug of the front housing through the screw.

10. The fan of claim 9, wherein number of the screw hole of the convex lug of the fixed ring is two, and the two screw holes are arranged at two ends of the convex lug of the fixed ring, respectively; numbers of the screw hole of the convex lug of the front housing and the screw hole column of the convex lug of the rear housing are both two, and the two screw holes of the convex lug of the front housing and the two screw hole columns of the convex lug of the rear housing are corresponding to the two ends of the convex lug of the fixed ring, respectively.

11. The fan of claim 10, wherein a rectangular reinforcing rib is arranged between the screw hole columns that are fit to the screw holes of the convex lug of the fixed ring.

* * * * *